US006823831B2

(12) United States Patent
Chu et al.

(10) Patent No.: US 6,823,831 B2
(45) Date of Patent: Nov. 30, 2004

(54) FLAME ARRESTOR SYSTEM FOR FUEL PUMP DISCHARGE

(75) Inventors: Yu-Sen James Chu, Westlake, OH (US); David J. Sandy, Avon, OH (US); Lori Ann DiLisi, Olmsted Falls, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 132 days.

(21) Appl. No.: 10/200,374

(22) Filed: Jul. 19, 2002

(65) Prior Publication Data

US 2002/0185114 A1 Dec. 12, 2002

Related U.S. Application Data

(63) Continuation-in-part of application No. 09/363,180, filed on Jul. 29, 1999, now Pat. No. 6,494,189.

(60) Provisional application No. 60/102,091, filed on Sep. 28, 1998.

(51) Int. Cl.[7] ..... F02M 37/04

(52) U.S. Cl. ..... 123/198 D; 123/497; 417/423.3

(58) Field of Search ..... 123/510, 497, 123/198 D, 446, 509; 417/423.3, 423.7, 366; 137/549

(56) References Cited

U.S. PATENT DOCUMENTS 2,846,952 A 8/1958 Ridland
3,308,410 A 3/1967 Bell
3,434,336 A 3/1969 Harr
3,607,604 A * 9/1971 Nava ..... 428/312.8
3,620,657 A * 11/1971 Robinson et al. ..... 431/9
3,635,599 A 1/1972 Bryant et al.
3,658,444 A * 4/1972 Rhodes et al. ..... 417/423.3
3,754,844 A 8/1973 Nusser et al.

(List continued on next page.)

OTHER PUBLICATIONS

Department of Transportation, Federal Aviation Administration (Federal Register, Jul. 24, 1998 (vol. 63, No. 142) Proposed Rules, p. 39765–39769.)
Article of Aerospace America entitled "What Happened to Flight 800" from the Mar. 1998 issue.
Proposed Rules, Federal Register, vol. 63, No. 77 dated Apr. 22, 1998.
Boeing Commercial Airplane Group Service Bulletin No. 747–28A2210 dated May 14, 1998.
Article from The Seattle Times dated Aug. 8, 1998 entitled Boeing Issues Warning of In–Tank Spark Hazard.
Pamphlet of Shaw Aero Devices, Inc. on Flame Arrestors (undated).
Technical Products Function Sheet of Foamex–Tech Products (undated).

*Primary Examiner*—Carl S. Miller
(74) *Attorney, Agent, or Firm*—John A. Molnar, Jr.

(57) ABSTRACT

A flame arrestor for a fuel pump having housing extending intermediate an upstream end defining an inlet port and a downstream end defining an outlet port coupled in fluid communication with the outlet port along a fluid flow path. The fuel pump further has a motor operably coupled to a pumping element. The arrestor is provided as a body received within the housing intermediate the outlet port and the motor. The arrestor body, which is formed of an open-cell foam material having an average pore size and thickness selected as being both fluid permeable and adapted to prevent an ignition source from propagating therethrough, is disposed in the fluid flow path such that fuel from the pumping element tank may be pumped to the outlet port through the body with the ignition source being prevented from passing into the outlet port.

18 Claims, 1 Drawing Sheet

U.S. PATENT DOCUMENTS 3,806,278 A 4/1974 Grennan
3,836,291 A 9/1974 Bottcher et al.
3,841,520 A * 10/1974 Bryant et al. ..... 220/88.2
3,870,910 A 3/1975 Fussner
3,889,649 A 6/1975 Polaner
3,896,964 A 7/1975 Takei et al.
3,897,179 A 7/1975 Fussner et al.
3,911,949 A 10/1975 Hilden et al.
3,947,362 A 3/1976 Etani
3,954,092 A 5/1976 Polaner
4,142,839 A 3/1979 Davis et al.
4,181,473 A 1/1980 Ina
4,268,289 A 5/1981 Polaner
4,275,988 A 6/1981 Kalashnikov et al.
4,426,190 A 1/1984 Shapiro et al.
4,500,270 A 2/1985 Tuckey
4,571,159 A 2/1986 Beardmore
4,619,588 A 10/1986 Moore, III
4,645,600 A 2/1987 Filippi
4,662,827 A 5/1987 Wiernicki
4,671,060 A 6/1987 Wilkens
4,676,463 A * 6/1987 Tansill ..... 244/129.2
4,682,936 A 7/1987 Suzuki et al.
4,763,632 A * 8/1988 Andreasson ..... 123/510
4,813,445 A 3/1989 Lu
4,877,368 A 10/1989 Timperi et al.
5,006,048 A 4/1991 Jow
5,007,806 A * 4/1991 Bellis et al. ..... 417/360
5,015,156 A 5/1991 Scholz
5,170,764 A * 12/1992 Tuckey ..... 123/509
5,203,296 A 4/1993 Hart
5,357,913 A 10/1994 Okumura et al.
5,375,565 A 12/1994 Maxson et al.
5,427,501 A 6/1995 Chu
RE35,404 E 12/1996 Brown
5,709,187 A 1/1998 Jaeger et al.
5,785,084 A * 7/1998 Richter et al. ..... 137/549
5,787,865 A * 8/1998 Harris et al. ..... 123/516
5,960,775 A * 10/1999 Tuckey ..... 123/509
6,155,238 A * 12/2000 Briggs et al. ..... 123/509
6,491,029 B2 * 12/2002 Kondou et al. ..... 123/509
6,494,189 B1 * 12/2002 Chu et al. ..... 123/509

* cited by examiner

FLAME ARRESTOR SYSTEM FOR FUEL PUMP DISCHARGE

CROSS-REFERENCE TO RELATED APPLICATION

This application is a continuation-in-part of U.S. application Ser. No. 09/363,180, filed Jul. 29, 1999, and claiming priority to U.S. provisional application Serial No. 60/102,091, filed Sep. 28, 1998, now U.S. Pat. No. 6,494,189 entitled "Flame Arrestor System for Fuel Pump Inlet," the disclosures of which are expressly incorporated herein by reference.

BACKGROUND OF THE INVENTION

The present invention relates generally to flame arrestors, and more particularly to a flame arrestor arrangement for the discharge or other outlet of an aircraft fuel pump.

Aircraft fuel systems conventionally employ multiple fuel tanks which may be mounted onboard in the wing or fuselage. The tanks typically are connected by transfer tubes, and by venting ducts which maintain atmospheric pressure in the tanks under normal flow conditions. In many fuel systems, transfer pumps are mounted on wing spars outside the wings to move fuel from one tank to another in order to "trim" the aircraft. Smaller, "scavenge" pumps also may be provided within the tanks to empty residual fuel after the remainder of the fuel has been drawn down to the level of the inlets of the principal transfer pumps. Pumps also are used to transfer fuel from remote tanks to the engine.

Accordingly, a number of fuel pumps, which may be mounted externally of the tank or, alternatively, internally mounted and submersed within the tank, typically are carried as on-board equipment in any given aircraft. In basic construction, aircraft fuel pumps conventionally are of a centrifugal-design employing a motor and an impeller which are enclosed within a housing. The motor is operably connected to the impeller via a drive shaft or the like, with the impeller, in turn, being coupled in fluid communication with inlet and outlet ports of the pump. During operation, the motor rotatably drives the impeller which develops a pressure drop drawing fuel or other working fluid from the associated tank through the pump inlet port and discharging the fuel, now under pressure, through the pump outlet port.

In a common construction, the impeller is provided as having an axially-extending hub or stem which is coupled to the drive shaft of the motor. Radially-extending, helical vanes are formed integrally with the hub and are enclosed by an axially-extending, generally cylindrical sleeve. The rotation of the impeller vanes within the sleeve draws the fuel or other liquid fluid into a volute chamber formed within the housing. The volute chamber converts the kinetic energy imparted to the fuel by the impeller into pressure for the discharge of the fluid through the pump outlet. Centrifugal pumps are available from a wide variety of manufacturers, including the Nichols Airborne Division of Parker-Hannifin Corp., Elyria, Ohio. Representative centrifugal pumps also are shown in commonly-assigned Chu, U.S. Pat. No. 5,427,501; Scholz, U.S. Pat. No. 5,015,156; and Lu, U.S. Pat. No. 4,813,445, as well as in Bellis et al., U.S. Pat. No. 5,007,806; Jow, U.S. Pat. No. 5,006,048; Timperi et al., U.S. Pat. No. 4,877,368; Wiernicki, U.S. Pat. No. 4,662,827; Moore, III, U.S. Pat. No. 4,619,588; Beardmore, U.S. Pat. No. 4,571,159; Tuckey, U.S. Pat. No. 4,500,270; Shapiro et al., U.S. Pat. No. 4,426,190; Kalashnikov, U.S. Pat. No. 4,275,988; Ina, U.S. Pat. No. 4,181,473; Davis et al., U.S. Pat. No. 4,142,839; Fussner et al., U.S. Pat. No. 3,897,179; Fussner, U.S. Pat. No. 3,870,910; Bottcher et al., U.S. Pat. No. 3,836,291; Grennan, U.S. Pat. No. 3,806,278; Nusser et al., U.S. Pat. No. 3,754,844; Carter, U.S. Pat. No. 3,652,186; Bell, U.S. Pat. No. 3,038,410; and Ridland, U.S. Pat. No. 2,846,952.

As aforementioned, certain centrifugal pumps used within aircraft fuel systems are mounted within the tank and therefore are termed in-tank or "wet" pumps. These pumps typically are orientated vertically within the tank, with the pump motor being located above the impeller in the direction of fuel flow. A certain minimum floor clearance generally is maintained between the impeller vanes and the bottom wall or floor of the tank to provide efficient pumping of fluid. Exemplary "wet" pumps are shown in U.S. Pat. Nos. 5,427,501; 5,015,156; and 2,846,952.

Alternatively, and as also was aforementioned, certain other centrifugal pumps used within aircraft fuel systems are mounted externally of the tank and therefore are termed "dry" pumps. These pumps, in contrast to wet pumps, may be oriented horizontally relative to the tank floor and mounted externally to the outside of the tank or to an adjacent support. A generally downwardly depending inlet tube, snorkel, hose or the like may be provided to extend in fluid communication from the pump impeller to a remote inlet port opening disposed above the tank floor. An exemplary "dry" pump is shown in U.S. Pat. No. 4,142,839.

An "in-line" variant, which may be either wet or dry, employs a linear or substantially linear flow path. Representative in-line pump constructions are shown, for example, in U.S. Pat. Nos. 5,006,048; 4,662,827; 4,619,588; 4,571,159; 4,500,270; 4,181,473; 3,897,179; 3,870,910; 3,836,291; and 3,754,844.

With fuel pumps of either variety, spark generation and flame propagation into the fuel tank are major safety concerns. In this regard, it is known that during dry operation of the pump, such as with an empty fuel tank, it is possible to generate a spark caused by a dragging impeller or by debris trapped between the impeller and its surrounding sleeve. Although not known ever to have occurred, there exists at least the potential for a spark or flame to propagate from the pump inlet into the fuel tank wherein the possibility for explosive combustion of residual fuel vapor exists. Proposed fuel pump constructions purporting to minimize spark generation and flame propagation are shown in Suzuki et al., U.S. Pat. No. 4,682,936 and Brown, U.S. Pat. No. Re. 35,404. Other techniques for improving the flame resistance of aircraft fuel systems and of combustion or turbine engines, or pumps in general are described in U.S. Pat. Nos. 5,709,187; 5,375,565; 5,357,913; 5,203,296; 4,671,060; 4,645,600; 4,676,463; 4,268,289; 3,947,362; 3,889,649; 3,911,949; 3,954,092; 3,841,520; 3,896,964; 3,635,599; and 3,434,336.

Proposals have been made for the use of flame arrestors for aircraft applications. In basic design, such arrestors are constructed as having a flame arresting element formed of a stainless steel or titanium material having a hexagonal honeycomb or a rectangular cell structure. The element, typically mounted in a housing, is installed within a fuel vent line, tank, or pump inlet to act as a barrier preventing a moving flame front from propagating into a location such as a fuel cell which may contain an explosive air/fuel mixture, while allowing for the flow of fuel or air to occur with minimal pressure drop. In having a surface area and material mass, the arrestor element functions to effect the transfer of heat from the flame front such that the temperature of the flammable mixture falls below its ignition temperature. In this way, the propagation of the flame is arrested. Commercial flame arrestors for aircraft applications are marketed by Shaw Aero Devices, Inc., Fort Meyers, Fla.

Recently, concerns have been expressed over the possibility that a spark generated at a fuel pump inlet by a dragging impeller or otherwise could propagate a flame into the fuel tank. Indeed, it has been speculated by Tischler in Aerospace America (March, 1998), and by Taylor in the Seattle Times News (Aug. 8, 1998) that an in-tank fuel pump could have played a role in the TWA Fight 800 disaster of 1996. In response, Boeing has issued a Service Bulletin, No. 7474-28A2210 (May 14, 1998), which provides instructions in the installation of a flame arrestor at the open end of the inlet tube of the scavenge pump for the center wing tank. The United States Federal Aviation Administration also has proposed adding new airworthiness directives to 14 C.F.R. Part 39 which would make the installation of such a flame arrestor a requirement.

The incorporation of a flame arrestor or other fire protection in certain pump design may prove more difficult than in others. For example, in the case of many pump designs, the motor element may be separated by a screen, housing wall, or the like from the pumping element such that arcing or other sparks or ignition sources, as may be generated by the movement of the commutator, are contained within the motor element and cannot contact the fluid in the pumping element. In the case of other pump designs, and particularly those of a modified in-line construction herein involved, the motor may not be physically separated from the pumping element. Accordingly, it is believed that the incorporation of a flame arresting feature into in-line pump designs would be well-received by the aviation industries.

BROAD STATEMENT OF THE INVENTION

The present invention is directed to a flame arrestor adapted for use within the fuel system of an aircraft, and particularly for pumps having a modified in-line design. Such design includes a housing which extends along a longitudinal axis from an upstream end which opens to define a suction or other inlet port, and a downstream end which opens to define a discharge or other outlet port. The housing contains a motor, which may be of a DC or AC variety, which is coupled in a torque or other force transmitting engagement by a shaft aligned generally coaxially with the longitudinal axis, or such other connection, to a pump element. The pump element, which may be a gerotor, vane, gear, impeller, or other assembly developing a positive displacement, centrifugal, or other motive force, generally will be positioned, relative to the longitudinal axis, intermediate the housing inlet end and the motor. A flow fluid path from the inlet to the outlet may be defined generally axially through the pump housing between the stator or magnets, and the rotor, i.e., armature, of the motor and otherwise generally along the longitudinal axis to thereby provide for a design having a relatively small envelope and which may be mounted within a tube, hose or other conduit.

In accordance with the present invention, a flame arrestor body is received within the housing, which may be of unitary or, more typically, a multi-piece construction, intermediate the outlet port and the motor. Such body is formed of an open cell, i.e., reticulated, foam material which may be a polyether- or polyester-based polyurethane elastomer. The foam has an average pore size and thickness selected as being both fluid permeable and adapted to prevent flame from propagating therethrough. In an illustrated embodiment, the arrestor body is received within an end-cap of the housing.

With the arrestor body being so provided, fuel may flow along the flow path defined within the pump from the inlet port to the outlet port and through the arrestor body, but with flame, sparking, or other ignition sources which may be generated by the motor being prevented from passing from the outlet port and into the fuel system. In this way, the potential of a fuel or fuel vapor ignition is reduced. Advantageously, the reticulated foam body functions both as a flame arresting device and as a fuel filter for the downstream components of the fuel system. Such an arrangement, moreover, is adaptable to accommodate fuel pumps of either a "wet" or "dry" type, and may be used in conjunction with an inlet arrestor such is described in co-pending parent application U.S. Ser. No. 09/363,180.

The present invention, accordingly, comprises the system possessing the construction, combination of elements, and arrangement of parts which are exemplified in the detailed disclosure to follow. Advantages of the invention includes a flame arresting system which is particularly adapted for aircraft applications, which may accommodate in-line and other fuel pumps of either a wet or dry type. These and other advantages will be readily apparent to those skilled in the art based upon the disclosure contained herein.

BRIEF DESCRIPTION OF THE DRAWING

For a fuller understanding of the nature and objects of the invention, reference should be had to the following detailed description taken in connection with the accompanying drawing wherein.

Figure 1:
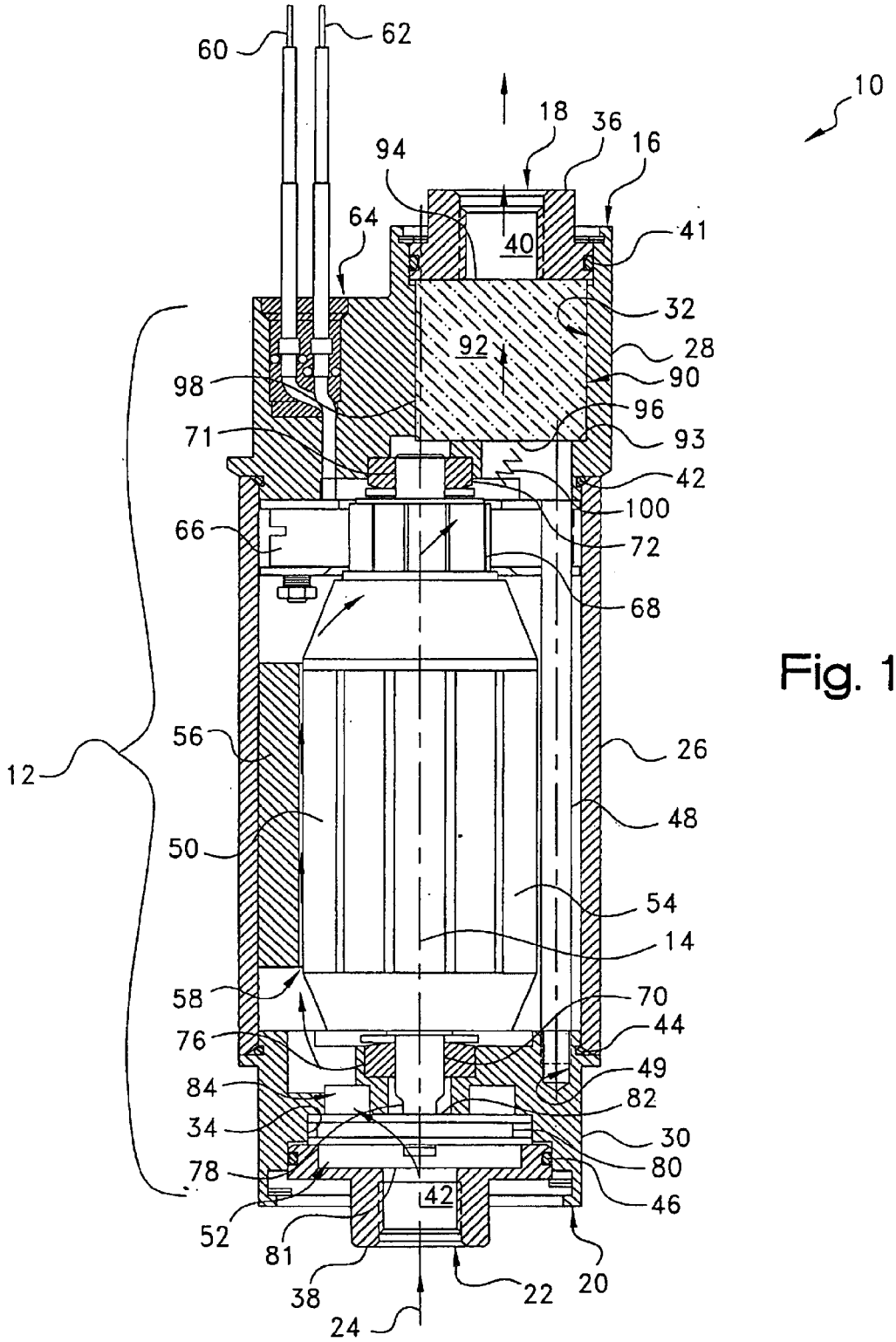
FIG. 1 is a cross-sectional view of a representative embodiment of flame arresting system in accordance with the present invention as adapted for use with an aircraft fuel pump of an inline construction.

The drawing will be described further in connection with the following Detailed Description of the Invention.

DETAILED DESCRIPTION OF THE INVENTION

Certain terminology may be employed in the following description for convenience rather than for any limiting purpose. For example, the terms "forward" and "rearward," "front" and "rear," "right" and "left," "upper" and "lower," "top" and "bottom," and "right"and "left" designate directions in the drawings to which reference is made, with the terms "inward," "inner," "interior," or "inboard" and "outward," "outer," "exterior," or "outboard" referring, respectively, to directions toward and away from the center of the referenced element, the terms "radial" or "horizontal" and "axial" or "vertical" referring, respectively, to directions or planes which are perpendicular, in the case of radial or horizontal, or parallel, in the case of axial or vertical, to the longitudinal central axis of the referenced element, and the terms "downstream" and "upstream" referring, respectively, to directions in and opposite that of fluid flow. Terminology of similar import other than the words specifically mentioned above likewise is to be considered as being used for purposes of convenience rather than in any limiting sense.

In the figure, elements having an alphanumeric designation may be referenced herein collectively or in the alternative, as will be apparent from context, by the numeric portion of the designation only. Further, the constituent parts of various elements in the figure may be designated with separate reference numerals which shall be understood to refer to that constituent part of the element and not the element as a whole. General references, along with references to spaces, surfaces, dimensions, and extents, may be designated with arrows. Angles may be designated as "included" as measured relative to surfaces or axes of an element and as defining a space bounded internally within such element therebetween, or otherwise without such designation as being measured relative to surfaces or axes of an element and as defining a space bounded externally by or outside of such element therebetween. Generally, the measures of the angles stated are as determined relative to a common axis, which axis may be transposed in the figure for purposes of convenience in projecting the vertex of an angle defined between the axis and a surface which otherwise does not extend to the axis. The term "axis" may refer to a line or to a transverse plane through such line as will be apparent from context.

For the illustrative purposes of the discourse to follow, the precepts of the flame arrestor of the present invention are described in conjunction with its incorporation within a wet or dry fuel pump of a modified in-line, gerotor variety for aircraft applications. In view of the discourse to follow, however, it will be appreciated that aspects of the present invention may find utility in fuel pumps of other types, such as vane, gear, or centrifugal impeller, and in other fluid systems, such as for ground transport vehicle applications, involving fuel pumps. Use within those such other pump types and applications therefore should be considered to be expressly within the scope of the invention herein involved.

Referring then to the figure, a representative fuel pump according to the present invention is shown generally at 10 in FIG. 1. Pump 10 includes a housing, referenced generally at 12, which extends along a longitudinal axis, 14, intermediate a downstream end, referenced at 16, which defines an outlet, i.e., discharge, port, referenced at 18, and an upstream end, referenced at 20, which defines an inlet, i.e., suction, port, referenced at 22. The inlet port 22 is coupled in fluid communication with the outlet port 18 along a fluid flow path, designated by the arrows 24, which runs axially through the housing 12 generally along the axis 14. The outlet and inlet ports 18 and 22 each may be aligned collinearly with axis 14 or, and as is shown for outlet port 18, displaced radially relative to axis 14.

Although housing 12 may be a generally unitary casting, molding, machining, or other manufacture, it more typically, and as shown, will be of a multi-piece construction comprising several assembled sections which may be joined together via fasteners, weldments or other bonding, interference fits or mechanisms, and/or threaded or other engagements. In the particular construction shown in FIG. 1, housing 12 includes a generally tubular portion, 26, which extends intermediate the housing downstream and upstream ends 16 and 20, with the downstream end 16 being configured as a first cap portion, 28, over one end of the housing tubular portion 26, and with the upstream end 20 being configured as a second cap portion, 30, over the other end of the housing tubular portion. Each of the cap portions 28 and 30 is configured to define an internal plenum, 32 and 34, respectively, each of which is covered by a fitting, 36 and 38, respectively. The upstream or outlet fitting 36 has an opening, referenced at 40, which defines the outlet port 18, with the downstream or inlet fitting 38 also having an opening, referenced at 42, which similarly defines the inlet port 22. As is shown, the joints between each of the respective housing sections 26, 28, 30, 36, and 38 may be sealed with o-rings or the like, such as at 41, 42, 44, and 46, with the housing 12 further being assembly with one or more studs, one of which may be seen at 48, which may extend, for example, through the first cap portion 28 and into a threaded engagement with an internally-threaded hole, 49, formed into second cap portion 30. In service, pump 10 may be installed, such as in a "dry" application, by connecting the fittings 36 and 38 between a break in a hose, tube, or other conduit extending externally of the fuel tank, or by the connection of the inlet fitting 38 directly to the tank or to a snorkel or other tubing extending within the tank. Alternatively, inlet port 22 may be configured, such as with a shroud or the like (not shown), for a "wet" application.

Assembled as described, housing 12 contains a motor assembly, referenced generally at 50, positioned intermediate the downstream and upstream ends 16 and 20 thereof, and coupled in driving force transmitting communication to a pumping assembly, referenced generally at 52, which is similarly contained within the housing 12, such as within plenum 34 of second cap portion 30, intermediate the motor assembly 50 and the housing upstream end 20. In basic construction, motor assembly 50 includes an armature, 54, which is journalled or otherwise supported within the housing part 26 in a clearance relationship therewith for rotation about the axis 14. Motor assembly 50, which for illustrative purposes is shown to be of a DC-type but which alternatively may be of an AC-type, also includes an array of fixed magnets (or stators in the case of an AC motor), one of which is referenced at 56, mounted generally coaxially with the axis 14 in the clearance gap, referenced at 58, between the armature 54 and the housing part 26. By way of convention, the terms "stator" and "magnet" should be understood to be used interchangeably herein. Magnets 56, each of which may be generally C-shaped or otherwise annular in radial cross-section, at least partially surround the armature 54, with the flow path 24 through the housing 12 thereby being defined through the remainder of the clearance gap 58 including through the spaces which may separate each of the magnets 56 in the array.

Motor assembly 50, which again may be either of a DC or AC-type, may be energized via the electrical leads 60 and 62, and additional leads or other wiring as may be necessary for power, feedback, monitoring, and/or control, entering the housing 12 through a soldered or otherwise sealed opening, 64, formed in the first end cap 28, and extending to into electrical connection with a brush or other contact subassembly, 66. Brush subassembly 66, in turn, contacts a commutator subassembly, 68, of the armature 54.

Armature 54 is coupled in torque-transmitting communication to a shaft, 70, which in the in-line construction of pump 10 extends generally coaxially with axis 14 from a first end portion, 71, rotatably journalled in a first bearing or bushing mount, 72, through the armature 54 and a second bearing or bushing mount, 76, and to a second end portion, 78, which is coupled in torque-transmitting communication to a driven member or component, 80, of the pumping assembly 52. In the illustrated embodiment of pump 10 of FIG. 1, the pumping assembly 52 is shown to be a gear set arrangement of a gerotor type such that the driven component may be an internal gear ring enmeshed for eccentric rotation within an external gear ring. However, and as mentioned, the pumping assembly 52 alternatively may be provided to be of a vane, gear, centrifugal impeller, or other type.

As is well known in the operation of mechanisms of the illustrated gerotor-type, and as is detailed further in U.S. Pat. Nos. 3,572,983; 4,411,607; 4,545,748; 4,586,885; 4,699,577; 4,813,856; 4,824,347; 4,881,880; 5,062,776; and 5,071,327, fluid chambers are defined by the enmeshing teeth of the internal and external gear rings, with those rings have a different number of teeth and being sized such that the fluid chambers sequentially expand and contract in volume as the gear rings are rotated relative to one another to develop a motive force for the flow fluid from a suction side to a pressure side of the assembly. As provided in fluid communication with the fluid flow path 24, pumping assembly 52 thus receives through a suction side, 81, thereof low pressure fluid admitted into path 24 via inlet port 22, and thus discharges high pressure fluid through a discharge side, 82, into a volute, chamber, or the like, 84, forming a segment of the flow path 24.

In accordance with the precepts of the present invention, a flame arrestor, referenced generally at 90, is incorporated within pump 10 as disposed intermediate the outlet port 18 and the motor assembly 50, and as coupled in fluid communication with the fluid flow path 24 such that fuel being discharged from the discharge side 82 of the pumping assembly 52 is pumped to the outlet port 18 through the body, 92, of the arrestor 90. In basic construction, the arrestor body 92, which may be generally cylindrically-shaped as shown, or of any generally spherical, polygonal, or irregularly-shaped volume, and which may be solid as shown or hollow, is formed of an open-cell, i.e., reticulated foam material having an average pore size and thickness which is selected as being both fluid permeable and adapted to prevent sparks or other ignition sources or flames from propagating therethrough. Advantageously, with arrestor body 92 being sized and shaped to be received within the plenum 32 of first cap portion, pressurized fuel or other fluid from the pumping assembly discharge side 82 may be pumped through the arrestor body 92 for discharge from the pump 10 through the outlet port 18, with flame, sparks, or other ignition sources, such as may be generated by the motor assembly 50, being prevented from passing through the port 18. Body 92 thereby functions both as a flame arrestor, and as a depth-type fluid filter in effecting the separation of particulate contaminates from the fuel being drawn therethrough. For the retention of body 92 within pump housing 12, the first cap portion 28 may be provided as having a radial-inwardly extending flange portion, 93, between which flange and the outlet fitting 36 the body 92 may be interposed.

Materials of construction suitable for molding, extruding, or otherwise forming arrestor body 92 may be selected from any of the known polymeric foam materials characterized as "flame retardant" in having an open cell pore network of a size and tortuosity such that as flame moves through the interstices thereof, it is cooled to a temperature below its gas flame combustion point and thereby is extinguished. Generally, such materials, which may be chemically or mechanically foamed, will have a density of between about 1–2 lbs/ft$^3$, with an average pore size of between about 10–50 pores per inch (ppi) (4–20 pores per cm). Flame retardancy of the material itself may be imparted by loading the foam composition with between about 30–50% by weight of one or more conventional flame retardant additives such as aluminum hydrate, antimony trioxide, phosphate esters, or halogenated compounds such as polybrominated diphenyl oxides. Although any such foams, including flexible or rigid, may be used, an elastomeric polyether- or polyester-based polyurethane foam may be considered preferred. Polyurethane foams are further described in U.S. Pat. Nos. 3,946,039; 3,862,282; 3,753,756; and 3,171,820, with foam of the preferred type being available commercially from Foamex International Inc., Linwood, Pa. Alternative, albeit somewhat less-preferred materials include foamed polyethylenes, polypropylenes, polypropylene-EPDM blends, butadienes, styrene-butadienes, nitrites, chlorosulfonates, neoprenes, and silicones. The exact size, depth, or thickness of the foam which is necessary to arrest the passage of flame therethrough is application specific to the pump installation, and generally will depend upon the performance requirements for the pump and upon other factors such as the volume and composition of the explosive fuel component or mixture, the area of the foam surface exposed to the flame front, the pressure drop through the foam, and the shape and size of the fuel pump.

In the embodiment illustrated in FIG. 1, arrestor body 92 is configured as having a downstream face, 94, disposed opposite outlet port 18, an upstream face, 96, disposed opposite motor assembly 50, and a circumferential radial surface, 98, which extends axially intermediate the faces 94 and 96. Fluid flow along the path 24 through body 92 thus is through the thickness dimension thereof as defined between faces 94 and 96, and is in the direction from upstream face 96 to downstream face 94. Depending upon the requirements of the specific application involved, the arrestor body 92 further may be contained within a surrounding, fluid permeable outer layer (not shown) which may be formed of a relatively thin, mild steel, aluminum, brass, copper, stainless steel, or other metal mesh or screen material. Such material may be selected as having a pore or other opening size of between about 0.05–0.13 inch (1.27–3.30 mm) to be relatively porous for admitting fluid into arrestor body 92. The material also may be selected to exhibit a transverse pressure drop, i.e., in a direction parallel to its surface, that is less than the pressure drop across body 92, i.e., in a direction perpendicular to its surface, for promoting a more uniform distribution of fluid across the corresponding surfaces of the body 92. Body 92 may be foamed-in-place within such outer layer to be self-adhesively bonded thereto. Alternatively, body 92 may be formed separately and then bonded to such outer layer using an adhesive, or otherwise mechanically joined with such outer layer in an interference fitting engagement.

In service, should a spark, flame, or other ignition source, referenced in phantom at 100, be generated, such as by motor assembly 50, the propagation of such ignition source out of the pump 10 through outlet port 18 is arrested by body 92. That is, as ignition source 100 travels along path 24, its propagation through the body 92 is arrested by the open cellular foam structure thereof. The source thus is extinguished within body 92 and is prevented from propagating out of the pump 10 wherein it could contact a potentially explosive fuel and gas mixture.

As it is anticipated that certain changes may be made in the present invention without departing from the precepts herein involved, it is intended that all matter contained in the foregoing description shall be interpreted as illustrative and not in a limiting sense. All references cited herein are expressly incorporated by reference.

What is claimed is:

1. A flame arrestor for a fuel pump having housing extending along a longitudinal axis intermediate an upstream end which defines an inlet port and a downstream end which defines an outlet port, the inlet port being coupled in fluid communication with the outlet port along a fluid flow path through the housing, and the fuel pump further having a motor contained within the housing intermediate the upstream and downstream ends thereof and coupled in driving force transmitting communication to a pumping element contained within the housing intermediate the motor and the housing upstream end and coupled in fluid communication with the fluid flow path, the arrestor comprising a body received within the housing in the fluid flow path intermediate the outlet port and the motor, the body being formed of an open-cell foam material having an average pore size and thickness selected as being both fluid permeable and adapted to prevent an ignition source from propagating therethrough, and the body being disposed in the fluid flow path such that fuel from the pumping element tank may be pumped to the outlet port through the body with said ignition source being prevented from passing into the outlet port.

2. The flame arrestor of claim 1 wherein the foam material has an average pore size of between about 10–50 pores per inch (4–20 pores per cm).

3. The flame arrestor of claim 2 wherein the foam material comprises a polyether-based or polyester-based polyurethane elastomer.

4. The flame arrestor of claim 1 wherein the housing has a generally tubular portion which extends intermediate the housing upstream and downstream ends, and wherein the housing downstream end is configured as a first cap portion over the housing tubular portion, the first cap portion having an internal first plenum and the arrestor body being received within the first plenum.

5. The flame arrestor of claim 4 wherein the housing downstream end is further configured as having an outlet fitting connected to the first cap portion, the outlet fitting covering the first plenum and having an opening which defines the outlet port.

6. The flame arrestor of claim 4 wherein the housing upstream end is configured as a second cap portion over the housing tubular portion, the second cap portion having an internal second plenum and the pumping element being received within the second plenum.

7. The flame arrestor of claim 6 wherein the housing upstream end is further configured as having an inlet fitting connected to the second cap portion, the inlet fitting covering the second plenum and having an opening which defines the inlet port.

8. The flame arrestor of claim 1 wherein the fuel pump motor includes an armature supported within the housing in a clearance relationship therewith for rotation about the longitudinal axis, and one or more generally annular magnets received generally coaxially with the longitudinal axis in the clearance between the armature and the housing and at least partially surrounding the armature, the flow path through the housing being defined by the clearance between the armature and the housing.

9. The flame arrestor of claim 8 wherein the motor armature is coupled in driving force transmitting communication to a driven component of the pumping element by a shaft disposed coaxially with the longitudinal axis.

10. A fuel pump comprising:

housing extending along a longitudinal axis intermediate an upstream end which defines an inlet port of the pump and a downstream end which defines an outlet port of the pump, the inlet port being coupled in fluid communication with the outlet port along a fluid flow path through the housing;

a motor contained within the housing intermediate the upstream and downstream ends thereof;

pumping element contained within the housing intermediate the motor and the housing upstream end, the pumping element being coupled in fluid communication with the fluid flow path and in driven force transmitting communication with the motor; and an arrestor body received within the housing in the fluid flow path intermediate the outlet port and the motor, the body being formed of an open-cell foam material having an average pore size and thickness selected as being both fluid permeable and adapted to prevent an ignition source from propagating therethrough, and the body being disposed in the fluid flow path such that fuel from the pumping element tank may be pumped to the outlet port through the body with said ignition source being prevented from passing into the outlet port.

11. The fuel pump of claim 10 wherein the foam material has an average pore size of between about 10–50 pores per inch (4–20 pores per cm).

12. The fuel pump of claim 11 wherein the foam material comprises a polyether-based or polyester-based polyurethane elastomer.

13. The fuel pump of claim 10 wherein the housing has a generally tubular portion which extends intermediate the housing upstream and downstream ends, and wherein the housing downstream end is configured as a first cap portion over the housing tubular portion, the first cap portion having an internal first plenum and the arrestor body being received within the first plenum.

14. The fuel pump of claim 13 wherein the housing downstream end is further configured as having an outlet fitting connected to the first cap portion, the outlet fitting covering the first plenum and having an opening which defines the outlet port.

15. The fuel pump of claim 13 wherein the housing upstream end is configured as a second cap portion over the housing tubular portion, the second cap portion having an internal second plenum and the pumping element being received within the second plenum.

16. The fuel pump of claim 15 wherein the housing upstream end is further configured as having an inlet fitting connected to the second cap portion, the inlet fitting covering the second plenum and having an opening which defines the inlet port.

17. The fuel pump of claim 10 wherein the motor includes an armature supported within the housing in a clearance relationship therewith for rotation about the longitudinal axis, and one or more generally annular magnets received generally coaxially with the longitudinal axis in the clearance between the armature and the housing and at least partially surrounding the armature, the flow path through the housing being defined by the clearance between the armature and the housing.

18. The fuel pump of claim 17 wherein the pumping element includes a driven component, and wherein the fuel pump further comprises a shaft disposed coaxially with the longitudinal axis, the shaft coupling the armature of the motor in driving force transmitting communication with the driven component of the pumping element.

* * * * *